United States Patent [19]

Hlinka et al.

[11] Patent Number: 4,784,209

[45] Date of Patent: Nov. 15, 1988

[54] CONTINUOUS CASTING APPARATUS

[75] Inventors: Joseph W. Hlinka, Bethlehem, Pa.; George J. Drumheller, Worcester, Mass.

[73] Assignee: Bethlehem Steel Corporation, Bethlehem, Pa.

[21] Appl. No.: 82,393

[22] Filed: Aug. 6, 1987

[51] Int. Cl.[4] ..... B22D 11/06

[52] U.S. Cl. ..... 164/428; 164/480

[58] Field of Search ..... 164/428, 480, 423, 463

[56] References Cited

U.S. PATENT DOCUMENTS

| | | | |
|---|---|---|---|
| 2,345,352 | 3/1944 | Merle | 164/113 |
| 3,794,106 | 2/1974 | Barsukov et al. | 164/428 |
| 4,380,262 | 4/1983 | Adler et al. | 164/423 |
| 4,546,814 | 10/1985 | Shibuya et al. | 164/428 X |

FOREIGN PATENT DOCUMENTS

| | | | |
|---|---|---|---|
| 1213965 | 4/1966 | Fed. Rep. of Germany | 164/428 |
| 54-23030 | 2/1979 | Japan | 164/423 |

OTHER PUBLICATIONS

Translation of Japanese Printed Publication 59-94525 published May 31, 1984.

*Primary Examiner*—Nicholas P. Godici
*Assistant Examiner*—J. Reed Batten, Jr.
*Attorney, Agent, or Firm*—John I. Iverson

[57] ABSTRACT

An apparatus for the continuous casting of molten metal between a pair of closely spaced water-cooled rolls in which the first roll is held in a fixed horizontal position by vertical support members attached to a structural base member. The second roll is also held in a horizontal position by vertical support members pivotedly attached to the structural base member in a manner such that the second roll is able to move freely and essentially in a horizontal direction with respect to the first roll during casting.

4 Claims, 3 Drawing Sheets

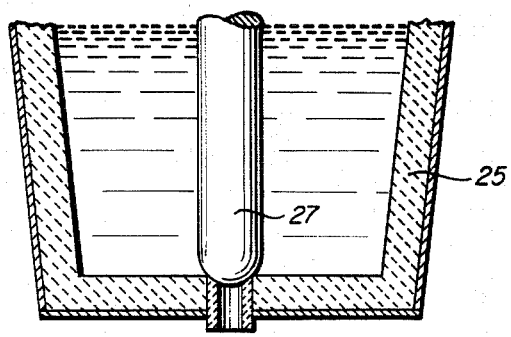
FIG. 1
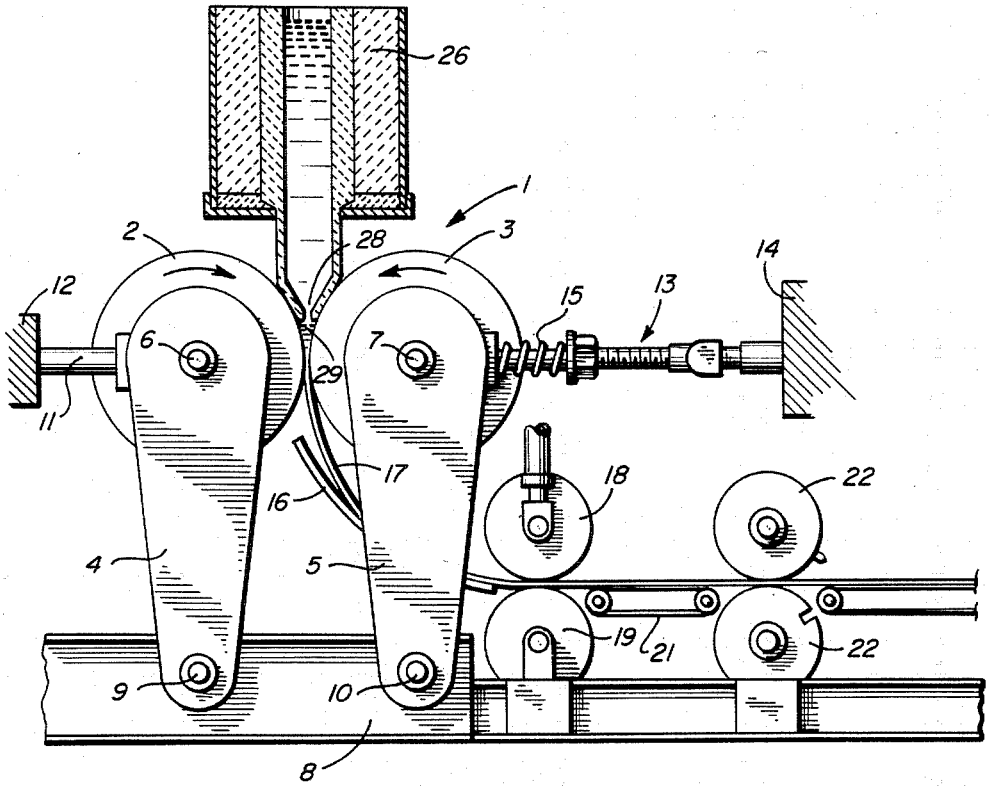

FIG. 2
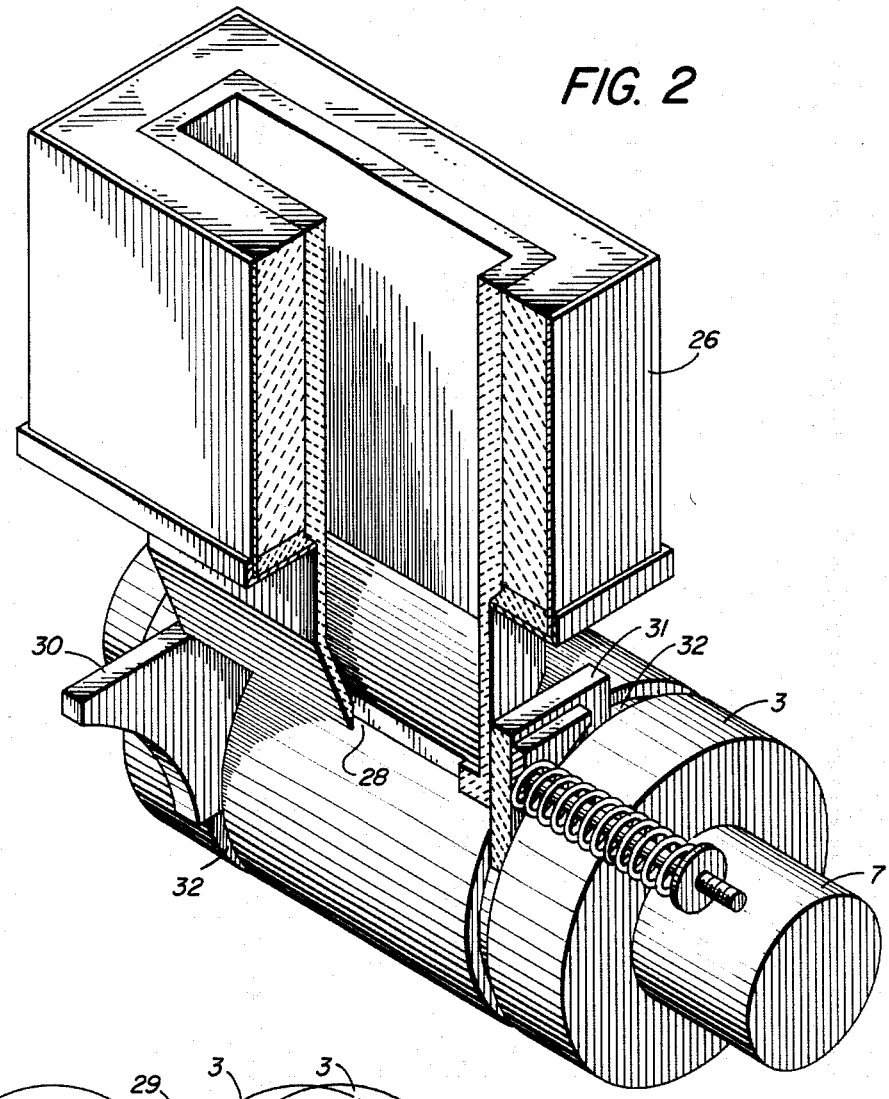
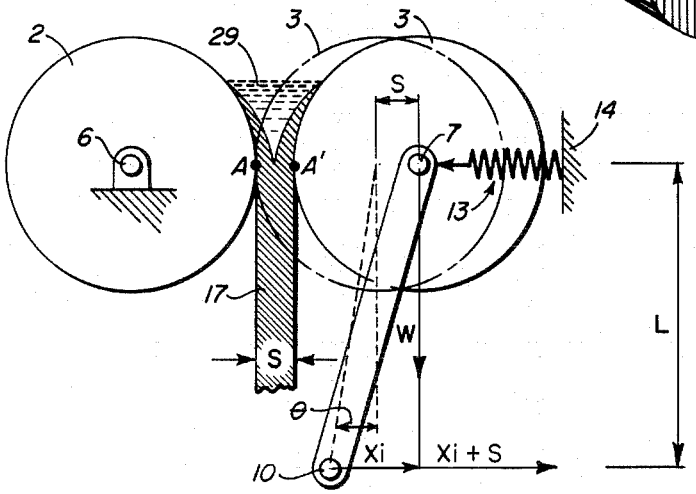
FIG. 3

CONTINUOUS CASTING APPARATUS

BACKGROUND OF THE INVENTION

This invention relates to the continuous casting of molten metals. It relates particularly to the continuous casting of molten steel between a pair of closely spaced water-cooled rolls whose axes lie horizontally and the rolls rotate in opposite directions.

The continuous casting of molten metal between a pair of closely spaced water-cooled rolls is well-known. Such a process was described and patented as early as 1865 in U.S. Pat. No. 49,053 to Bessemer. Since then there have been a number of other U.S. and foreign patents describing twin roll continuous casting apparatus similar to that of Bessemer but to date, none of these prior twin roll continuous casting machines have been able to produce steel strip of acceptable commercial quality.

In the prior apparatus of Bessemer and the others, the twin rolls were essentially preset with a gap between the rolls corresponding to the strip thickness to be cast. In most of these machines the constrained twin rolls are designed to provide a sufficient force to compress and hot roll the strip as it solidifies to the desired thickness.

We have found that when the twin rolls are constrained there occurs frequent cracking of the solidifying strip as it leaves the rolls, as well as bleeding, tearing and distortion of the strip, making much of the cast product unusable except as scrap.

SUMMARY OF THE INVENTION

It is an object of this invention to provide an apparatus for the continuous casting of molten metals, especially steel, that is simple in construction and operation and able to accommodate a number of casting variables.

It is a further object of this invention to provide an apparatus for the continuous casting of molten metals that avoids imposing any undesirable forces on the solidifying strip.

It is a still further object of this invention to provide an apparatus for the continuous casting of molten metal into strip of commercially acceptable quality, and capable of producing a variety of strip thicknesses without interrupting the casting process.

It has been discovered that the foregoing objectives can be attained by continuous casting apparatus comprising a base member, two pairs of vertical members which support the closely spaced casting rolls in a horizontal position, at least one pair of the vertical support members supporting a roll being pivotally connected to the base member to allow the roll they support to move freely and essentially in a horizontal direction with respect to the other casting roll.

BRIEF DESCRIPTION OF THE DRAWINGS

FIG. 1 is an elevation view of a preferred embodiment of the continuous casting apparatus of this invention.

FIG. 2 is an isometric view of a portion of the continuous casting apparatus of this invention.

FIGS. 3 and 4 are diagrams to illustrate the geometry used in the continuous casting apparatus of this invention.

DESCRIPTION OF A PREFERRED EMBODIMENT

Figure 4:
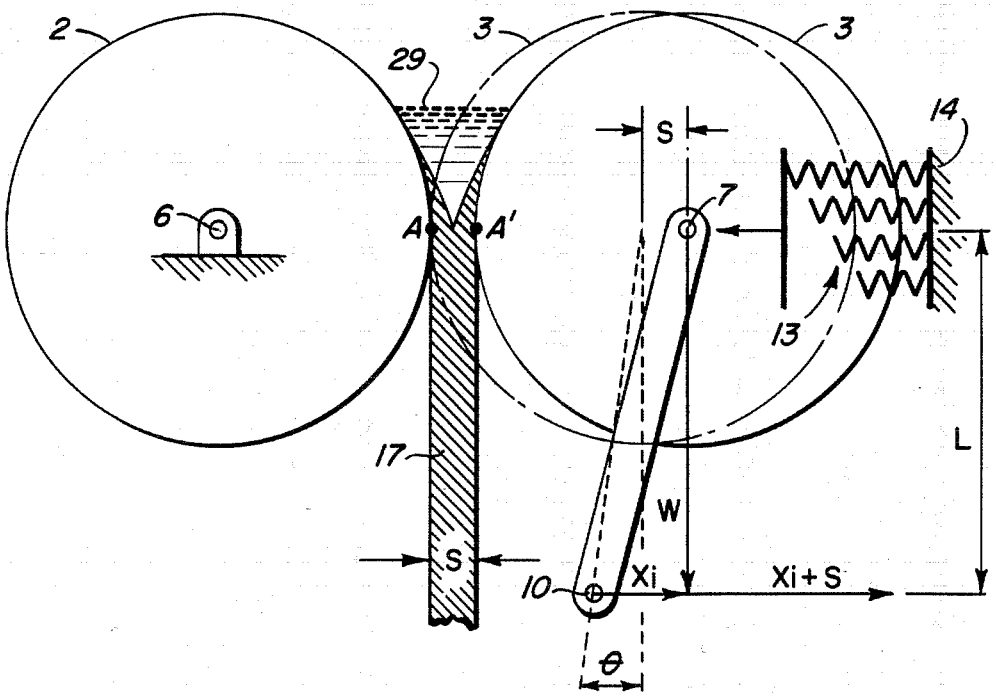

FIG. 1 illustrates a preferred embodiment of the continuous casting apparatus of this invention which is designed to cast steel strip in a range of thicknesses between 10 and 100 mils thick at rates of at least 5 tons per hour per foot of width.

The continuous casting apparatus 1 of this invention comprises a pair of closely spaced water-cooled rolls 2 and 3 which are about 12 inches in diameter. The rolls 2 and 3 are preferably the same diameter but could be of different diameters, if desired. The rolls 2 and 3 are preferably made of copper and water-cooled to cause a rapid solidification of the molten metal, but could be made of other materials and composites capable of withstanding the temperatures involved.

Rolls 2 and 3 are supported in a substantially horizontal plane by having the longitudinal axis of each of the rolls connected to a pair of vertical support members 4 and 5 by bearings 6 and 7 which permit the rolls to rotate in opposite directions as indicated by the arrows. The rolls are rotated by variable speed electric or hydraulic motors (not shown).

The roll support members 4 and 5 are connected to a rigid base member 8 by pins 9 and 10. Links 11 attached to support members 4 and a fixed anchor 12 hold roll 2 in a fixed horizontal position during casting. Links 11 may be disconnected between casts to permit assembly and disassembly of the continuous casting apparatus 1. Adjustable resilient assembly 13 connect the roll support members 5 which hold casting roll 3 in a horizontal position to a fixed anchor 14. As shown in FIG. 1, a spring 15 provides the resilient feature of resilient rod assembly 13 whose operation will be described later in further detail.

Directly beneath the twin casting rolls 2 and 3 is a guide chute 16 which guides the newly cast strip 17 from a vertical to a horizontal direction. If desired, a pair of pinch rolls 18 and 19 can be used to flatten and compress the solidified strip 17 prior to it being coiled or sheared to length by a rotary shear 22 placed along the run-out conveyor 21. The primary function of the pinch rolls 18 and 19 is to guide the strip 17 to the coiler or shear 22. However, the pinch rolls can be designed to give an in-line reduction in thickness to the strip 17, if desired.

The continuous casting apparatus 1 is supplied with molten steel from a refractory lined vessel 25 which discharges the molten steel into a refractory lined pouring box 26. The ladle operator maintains a predetermined level of molten steel in the pouring box 26 by controlling the ladle stopper 27.

The pouring box 26 as illustrated in FIGS. 1 and 2 has a slot 28 or orifices as means of distributing the molten steel across the full width of the twin casting rolls 2 and 3 providing a substantially uniform distribution of molten steel into a molten steel pool 29 between the casting rolls 2 and 3. The molten steel pool 29 is maintained between the casting rolls 2 and 3 by refractory edge dams 30 and 31 shown in FIG. 2. The edge dams 30 and 31 are set into an undercut groove 32 cut in each end of the casting rolls 2 and 3 and are spring-loaded to force the edge dams against the undercut shoulder of the casting rolls 2 and 3 to prevent molten metal leakage. The edge dams 30 and 31 may be heated to prevent excessive chilling of the molten metal pool 29.

In Bessemer's arrangement, and others who followed, the casting rolls while casting are essentially preset with a gap corresponding to the strip thickness to be cast. In such arrangements the rolls are provided with a sufficient force for the consolidation and subsequent hot rolling of the solidifying strip to the preset thickness.

To constrain the casting rolls and rely on hot rolling reduction to produce the desired strip thickness, is a serious error due to the lack of a proper understanding of the process. We have found that optimum strip quality can be achieved only within a narrow range of a unique combination of the thermo-mechanical casting parameters. Exceeding these parameters causes (1) excessive hot rolling reduction accompanied by distortion and cracking of the strip or (2) the strip leaves the casting rolls partly liquid with attendant bleeding, tearing and distortion of the strip.

Casting of steel strip between twin rolls requires continuous operation of the apparatus while temperatures and other parameters vary. Results from our analytic and experimental investigations reveal that the twin roll casting process must be controlled in a way as to accommodate the rate of solidification—i.e., the progression of the freezing front defining the developing shell thickness.

The liquid metal in the twin roll caster must be free to solidify at whatever rate as determined by the changing conditions then prevailing. The material cannot be passed through the casting rolls by the application of excessive compressive forces without causing damage to the strip nor allowed to exit the rolls in a partially solidified state.

In the past, the necessity for the twin roll caster to continuously adapt to changing conditions which affect the rate of solidification had not been realized in the design of the machines; rather past designs reflect an overriding condition of casting strip of preset thickness.

We have discovered that, for the successful operation of a twin roll caster there are two interrelated requirements; namely, strip thickness and roll force. Both requirements must be satisfied simultaneously that one requirement only may be preset by the apparatus, while the other requirement is controlled by operational means to respond to changes in the rate of solidification.

We have found for the successful production of strip that the force applied to the rolls in opposition to the separating forces developed by the solidifying strip must be maintained below a critical range above which damage to the strip by excessive hot rolling is evidenced. Because of the criticality of the applied force, contributions from extraneous forces such as friction and gravity must be avoided. Free movement of one casting roll 3 is accomplished in this invention by the inverted pendulum support members 5 and the resilient rod assemblies 13 which not only minimizes the number of bearing surfaces but also reduces the effect of the bearing friction forces on the strip by the length of the pendulum arm from pin 10 to bearing 7. This feature is better shown in FIG. 3.

Referring to FIG. 3, the initial position of the fixed casting roll 2 and the movable roll 3 before casting is illustrated by the broken lines. In this initial position the center of gravity of the unconstrained movable roll 3 is set at a displaced distance $x_i$ from the pivot pin 10. The horizontal or turning component of the gravity force is given by $$Fg = W\theta_i = Wx_i/L \tag{1}$$

where a = spring constant (lbs/in.)
b = initial (preload) spring force (lbs)
$F_A$ = force applied to the strip (lbs)
Fg = horizontal component of the gravity force (lbs)
Fs = spring force (lbs)
L = length of pendulum support arm (inches)
S = variable displacement of rolls or strip thickness (inches)
x = horizontal displacement of the roll center of gravity from the support arm pivot point (inches)
$\theta$ = angle between centerline of support arm and vertical (radians)
W = weight of casting roll (lbs)

As the separating forces of the solidifying strip displace the roll 3 a distance S from $x_i$, a new value for the gravity force develops namely $$Fg = W\theta = W(x_i + S)/L \tag{2}$$

The returning force of the spring is given by $$Fs = aS + b \tag{3}$$

To produce a zero force on the strip at point A for all values S, we equate Equations 2 and 3 and find that with a spring constant $$a = W/L \tag{4}$$

and with $$b = Wx_i/L \tag{5}$$

the force at point A is zero for all values of S within the limits of the small angle approximation made in Equation 1.

Thus, by selecting a spring with a spring constant equal to the ratio of the weight of the roll 3 to length of the pendulum support arms 5, and setting the initial spring compression as b we obtain a zero roll force condition on the solidifying strip for a wide range of variation in the strip thickness.

Under the same conditions, if the initial preload force b is set at a value greater than $Wx_i/L$ then the force applied to the strip is the difference between b and $Wx_i/L$; said applied force will remain constant for a wide range of variation in strip thickness.

For those skilled in the art a more general equation for the applied roll force may be useful; namely, $$F_A = W(S + x_i)/L + \sum_{n=1}^{n=m} a_n(S - S_n) + b_n \tag{6}$$

In Equation (6) n denotes spring n having a spring constant $a_n$ and an initial preload force $b_n$; and, m denotes the total number of springs in a spring pack arrangement.

Equation (6) includes multiple spring pack assembles as shown in FIG. 4 wherein each spring becomes active after a predetermined displacement. Such arrangements can produce nonlinear relationships between the roll displacement and the force applied to the rolls.

Use of Equation (6) is given by the following examples:

EXAMPLE 1

Conditions: One spring on each pendulum arm.
Direct casting of one-foot wide strip.
See FIG. 3 for description and nomenclature.
Total pendulum weight 4800 lbs.
Pendulum half-weight carried by each arm of the unconstrained roll bearings. W=2400 lbs
Pendulum arm length. L=12 inch
Spring constant ($a_1=W/L$) $a_1=200$ lbs/in.
Initial spring loading (S=0) $b_1=0$
Pivot point location (S=0) $x_1=0$
With a single spring (m=1) active for S>0 Equation (6) reduces to $$F_A=W(S+x_i)/L-(a_1S+b_1)$$

The negative sign indicating the counterclockwise moment of the spring force. With $x_i$ and $b_n$ equal to zero, we have from the selected conditions, $$\begin{aligned} F_A &= WS/L - a_1S \\ &= \frac{2400}{12}S - 200S = 0 \end{aligned}$$

Thus, it is shown as before, that in the present invention a zero force is applied against the strip even as the strip thickness varies over a wide range.

EXAMPLE 2

Conditions: One spring on each pendulum arm.
Direct casting of one-foot wide strip.
See FIG. 3 for nomenclature.
Under the same conditions as in Example 1 but with the springs on each end of the roll initially (at S=0) compressed to 2000 lbs. Thus, with $b_1=2000$ and $x_i=0$ $$\begin{aligned} F_A &= WS/L - (a_1S + b_1) \\ &= \frac{2400}{12}S - 200S - 2000 \\ F_A &= -2000 \text{ lbs} \end{aligned}$$

Thus, it is shown that in the present invention a constant force may be applied against the strip and maintained at the initial setting even as the strip thickness varies over a wide range.

EXAMPLE 3

Conditions One spring on each pendulum arm.
Direct casting of one-foot wide strip.
See FIG. 3 for nomenclature.
Under the same conditions as in Example 2 but with the spring constant selected as a=10000 lbs/inch $$\begin{aligned} F_A &= WS/L - (a_1S - b_1) \\ &= 2400/12S - 10000S - 2000 \\ &= -9800S - 2000 \end{aligned}$$

Thus, it is shown with the present invention a force, having an intercept and linearly increasing with strip thickness may be applied against the separating force developed by the solidifying strip.

We claim:

1. Apparatus for the continuous casting of molten metal comprising:
   (a) a base member;
   (b) a first pair of vertical support members connected to said base member and supporting a first rotatable cylindrical casting roll in a fixed horizontal position above said base member;
   (c) a second pair of vertical support members pivotally connected to said base member and supporting a second rotatable cylindrical casting roll, in a horizontal position above said base member;
   (d) spring means to adjust the position of said second casting roll relative to said first casting roll.

2. The apparatus of claim 1 in which the casting rolls are water-cooled.

3. The apparatus of claim 1 in which the casting rolls are made of copper.

4. The apparatus of claim 1 in which the spring constant of the spring means used to position said second casting roll relative to said first casting roll is equal to the ratio of the weight of the second casting roll to the length of said second vertical support members between said pivoted connector to the base members and the horizontal axis of said second casting roll.

* * * * *